US009167648B2

(12) United States Patent
Yamahara et al.

(10) Patent No.: US 9,167,648 B2
(45) Date of Patent: Oct. 20, 2015

(54) LIGHTING DEVICE AND LUMINAIRE

(71) Applicant: Panasonic Corporation, Osaka (JP)

(72) Inventors: Daisuke Yamahara, Osaka (JP); Takeshi Kamoi, Kyoto (JP); Keisuke Seki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/341,965

(22) Filed: Jul. 28, 2014

(65) Prior Publication Data

US 2015/0035446 A1 Feb. 5, 2015

(30) Foreign Application Priority Data

Aug. 2, 2013 (JP) ..... 2013-161861

(51) Int. Cl.
*H05B 37/02* (2006.01)
*H05B 33/08* (2006.01)

(52) U.S. Cl.
CPC ..... *H05B 33/0818* (2013.01)

(58) Field of Classification Search
USPC ..... 315/185 R, 186, 224–226, 291, 294, 315/297, 299, 300, 307, 308, 360
See application file for complete search history.

(56) References Cited

U.S. PATENT DOCUMENTS

| | | | | |
|---|---|---|---|---|
| 7,919,936 | B2 | 4/2011 | Liu et al. | |
| 8,148,919 | B2 | 4/2012 | Liu et al. | |
| 8,237,379 | B2 | 8/2012 | Liu | |
| 8,253,352 | B2 | 8/2012 | Liu | |
| 8,593,067 | B2 | 11/2013 | Iwai et al. | |
| 2008/0224625 | A1* | 9/2008 | Greenfeld | 315/201 |
| 2010/0026208 | A1* | 2/2010 | Shteynberg et al. | 315/297 |
| 2010/0033109 | A1 | 2/2010 | Liu et al. | |
| 2011/0181198 | A1 | 7/2011 | Iwai et al. | |
| 2011/0248648 | A1 | 10/2011 | Liu | |
| 2011/0316447 | A1 | 12/2011 | Liu | |
| 2012/0032613 | A1 | 2/2012 | Liu et al. | |
| 2012/0187847 | A1* | 7/2012 | Hamamoto et al. | 315/125 |
| 2012/0262087 | A1 | 10/2012 | Watanabe et al. | |
| 2014/0009080 | A1* | 1/2014 | Xu | 315/224 |

FOREIGN PATENT DOCUMENTS

| | | |
|---|---|---|
| JP | 2010-040509 | 2/2010 |
| JP | 2011-155101 | 8/2011 |
| JP | 2011-223800 | 11/2011 |
| JP | 2012-109141 | 6/2012 |
| JP | 2012-221899 | 11/2012 |
| JP | 2013-069766 | 4/2013 |

* cited by examiner

*Primary Examiner* — Tung X Le
(74) *Attorney, Agent, or Firm* — Renner, Otto, Boisselle & Sklar, LLP

(57) ABSTRACT

A lighting device that lights up an LED and includes a DC power source, a buck converter and a control circuit. The buck converter includes a switching element, an inductor and a diode. The control circuit includes a current detection circuit that detects an electric current flowing through the switching element, a voltage detection circuit that detects a voltage across the inductor, a delay circuit that generates a delay time according to the voltage detected by the voltage detection circuit, and a drive circuit that generates and outputs a control signal to the switching element, the control signal turning OFF the switching element after a lapse of the delay time generated by the delay circuit from when the electric current detected by the current detection circuit reaches a predetermined current command value.

9 Claims, 12 Drawing Sheets

LIGHTING DEVICE AND LUMINAIRE

CROSS REFERENCE TO RELATED APPLICATION

This application claims the benefit of priority of Japanese Patent Application Number 2013-161861, filed Aug. 2, 2013, the entire content of which is hereby incorporated by reference.

TECHNICAL FIELD

The disclosure relates to a lighting device that lights up a solid-state light-emitting element such as an LED, and a luminaire including the lighting device.

BACKGROUND ART

Desirably, a lighting device that stably lights up LEDs (light emitting diodes) serving as loads should be under constant current control, which outputs a constant output electric current for any load. The reason is as follows: the voltage-current characteristics of an LED element have a non-linear feature in which an electric current starts flowing suddenly at a certain applied voltage or higher, a forward voltage does not substantially change while an electric current near a rated current value is flowing, and light output basically depends on a value of an electric current that is flowing. By providing control so that a constant electric current flows through the LED element for any output voltage, the constant current control can reduce variations in light output in the case where there are variations in lighting voltage due to the individual difference among the LED elements. Also, even when loads having different rated lighting voltages are connected or even when the number of loads connected in series is changed, the constant current control can accommodate various connection styles because a constant electric current can be passed through the loads.

Conventionally, various lighting devices have been proposed that suppress the variations in light output of LED elements based on the constant current control described above (for example, see Japanese Unexamined Patent Application Publications No. 2012-109141 and No. 2010-40509).

In Japanese Unexamined Patent Application Publication No. 2012-109141, it is contrived how to reduce variations in output electric current due to voltage ripples of a DC power source.

In general, a buck converter is operated by boundary current mode (BCM) control and peak current control, making it possible to pass a constant electric current through an LED connected to the buck converter regardless of a forward voltage of the LED. Herein, the BCM control and the peak current control turn OFF a switching element when an electric current value detected by a current detection circuit reaches a predetermined value, and turn ON the switching element when release of predetermined energy from an inductor is detected, in the buck converter. In such a BCM control, an average output electric current is half the electric current peak value. In the peak current control, the switching element is turned OFF when the electric current flowing through the inductor reaches a peak current reference value Iref. In this way, the peak value of the electric current flowing through the inductor is matched to the reference value Iref, making it possible to keep the output electric current at a constant value (½ of the current reference value Iref) regardless of the output voltage. However, components constituting the buck converter have a delay time (for example, a delay time of a detection operation circuit, a signal output delay time of a driver IC, a drive delay time of the switching element, etc.). Accordingly, there occurs a delay from when the electric current flowing through the inductor reaches the peak current reference value Iref until the switching element is turned OFF. When an input voltage of the buck converter ripples, such a delay time causes an actual peak value Ipeak of the electric current flowing through the inductor to be larger than the reference value Iref, so that the light output is also varied. In response to the above problem, Japanese Unexamined Patent Application Publication No. 2012-109141 detects a voltage corresponding to the input voltage of the buck converter using a secondary winding of the inductor so as to correct the peak current reference value Iref.

On the other hand, Japanese Unexamined Patent Application Publication No. 2010-40509 contrives, in a lighting device including a plurality of outputs (output terminals), a circuit in which electric currents from the individual outputs are equated with one another. With respect to a common electric current reference value REF, individual buck converters calculate an average electric current flowing through switching elements, and perform feedback control so as to match the average electric current with the reference value. In other words, an electric current flowing through the switching element of each buck converter is monitored, and the difference between a monitored electric current Isen and the reference electric current REF is calculated by an error amplifier. Then, by calculating a logical sum of an output of the error amplifier and a sawtooth waveform (a RAMP waveform), a duty ratio of a drive signal of the switching element is regulated so that an average value of the monitored electric current Isen and the REF are equated with each other during a period in which the switching element is ON. In such a control, the constant current control is performed normally by a continuous current mode (CCM).

SUMMARY

However, the techniques in Japanese Unexamined Patent Application Publications No. 2012-109141 and No. 2010-40509 described above have the following problems.

Although the delay time of the components constituting the buck converter has been considered, the technique described in Japanese Unexamined Patent Application Publication No. 2012-109141 is intended to solve the variations in output electric current due to the ripples of the input voltage of the buck converter. Thus, such a technique cannot improve the electric current variations at the time of variations in output voltage due to the delay time. Accordingly, the output voltage-current characteristics achieve not a perfectly constant electric current but an increasing output electric current with a decrease in the output voltage. In a lighting device with such characteristics, it is conceivable that the individual difference in voltage-current characteristics and temperature characteristics of loads (namely, LEDs) to be connected may bring about variations in light output depending on the loads or may vary the light output over time. Further, when different kinds of loads (namely, LEDs) having the same current rating and different voltage ratings are connected or when the number of loads connected in series is changed, it is also conceivable that the difference in output voltage may cause the output electric current to deviate from a rated value, and thus a desired light output cannot be obtained.

Further, in the technique described in Japanese Unexamined Patent Application Publication No. 2010-40509, with respect to the common electric current reference value REF, the individual buck converters calculate the average electric current flowing through the switching elements and perform the feedback control so as to regulate it to match the current reference value, thereby equating the electric currents from the individual outputs with one another. However, since the error amplifier and peripheral circuits are necessary for constituting the feedback circuit, the cost of circuit components increases. Moreover, since the drive signal of the switching element is generated by calculating the logical sum of the output of the error amplifier and the sawtooth waveform (the RAMP waveform), a switching frequency always coincides with a frequency of a sawtooth wave (a RAMP wave). In other words, the operation is basically performed by the continuous current mode (CCM) at a constant frequency. In the continuous current mode, the electric current flowing through the inductor of the buck converter is continuous and does not return to 0. Thus, there arises a significant stress and loss, for example, a through-current flows through the components such as the switching elements of the buck converter in order to switch ON/OFF the continuous electric current. This lowers a circuit efficiency, raises the cost of circuit components and increases a circuit size. The above-described technique is not suitable especially for high-power illumination uses.

The present invention has been made bearing the foregoing in mind, and it is an object of the present invention to provide a lighting device that is operated by the BCM control and the peak current control, and capable of stably lighting up solid-state light-emitting elements having different properties while suppressing variations in light output of these elements with a simple configuration.

In order to achieve the object mentioned above, a lighting device according to one aspect of the present invention is a lighting device that lights up a solid-state light-emitting element. The lighting device includes a DC power source; a buck converter that is a constant current output converter, and receives an electric current from the DC power source and supplies a predetermined electric current to the solid-state light-emitting element; and a control circuit that controls the buck converter. The buck converter includes: a switching element; an inductor that is connected in series with the switching element, and through which the electric current from the DC power source flows when the switching element is ON; and a diode that supplies, to the solid-state light-emitting element, the electric current released from the inductor. The control circuit includes: a current detection circuit that detects an electric current flowing through the switching element; a voltage detection circuit that detects either one of a forward voltage of the solid-state light-emitting element and a voltage across the inductor; a delay circuit that generates a delay time according to the voltage detected by the voltage detection circuit; and a drive circuit that generates and outputs a control signal to the switching element, the control signal turning OFF the switching element after a lapse of the delay time generated by the delay circuit from when the electric current detected by the current detection circuit reaches a predetermined current command value, and turning ON the switching element when the inductor releases predetermined energy.

Herein, the delay circuit may generate the delay time so that a peak value of the electric current flowing through the inductor is kept constant regardless of the voltage detected by the voltage detection circuit.

Further, the delay circuit may generate the delay time that is extended with either one of an increase in the forward voltage of the solid-state light-emitting element and a decrease in the voltage across the inductor.

Moreover, the delay circuit may generate a minimum delay time as the delay time when the forward voltage of the solid-state light-emitting element connected to the lighting device is at a minimum value Vout_min, where Vout_min denotes a minimum value of the forward voltage of the solid-state light-emitting element to be connected to the lighting device.

Also, the drive circuit may include: a flip-flop that is reset when the electric current detected by the current detection circuit reaches the predetermined current command value, and set when the inductor releases the predetermined energy; and a buffer amplifier that outputs an output signal from the flip-flop to the switching element as the control signal. The buffer amplifier may output an output signal indicating that the flip-flop has been reset to the switching element after the lapse of the delay time generated by the delay circuit.

Additionally, the drive circuit may include: a flip-flop that is reset after the lapse of the delay time generated by the delay circuit from when the electric current detected by the current detection circuit reaches the predetermined current command value, and set when the inductor releases the predetermined energy; and a buffer amplifier that outputs an output signal from the flip-flop to the switching element as the control signal.

Further, the lighting device may lights up a plurality of solid-state light-emitting elements. The buck converter may include a plurality of buck converters that are in one-to-one correspondence with the plurality of solid-state light-emitting elements, and the control circuit may include a plurality of control circuits that respectively control the plurality of buck converters.

Moreover, the lighting device may further include a dimming control circuit that outputs the current command value according to a desired light output to the plurality of control circuits.

Also, in order to achieve the object mentioned above, a luminaire according to one aspect of the present invention includes the lighting device described above; and a solid-state light-emitting element to which an electric current is supplied from the lighting device.

One aspect of the present invention achieves a lighting device that is operated by the BCM control and the peak current control, and capable of stably lighting up solid-state light-emitting elements having different properties while suppressing variations in light output of these elements with a simple configuration, and a luminaire including the lighting device.

Thus, the present invention is of great practical value in today's world where illuminating devices including a solid-state light-emitting element such as an LED have become widespread.

BRIEF DESCRIPTION OF THE DRAWINGS

The figures depict one or more implementations in accordance with the present teaching, by way of examples only, not by way of limitations. In the figures, like reference numerals refer to the same or similar elements.

DETAILED DESCRIPTION

In the following, embodiments of the present invention will be described in detail, with reference to accompanying drawings. It should be noted that any of the embodiments described below will illustrate one specific preferable example of the present invention. The numerical values, shapes, materials, structural components, the arrangement and connection of the structural components, steps and the order of the steps mentioned in the following embodiments are merely an example and not intended to limit the present invention. Also, among the structural components in the following embodiments, the one that is not recited in any independent claim exhibiting the most generic concept of the present invention will be described as an arbitrary structural component constituting a more preferable mode.

Embodiment 1

First, a lighting device according to Embodiment 1 of the present invention will be described.

Figure 1:
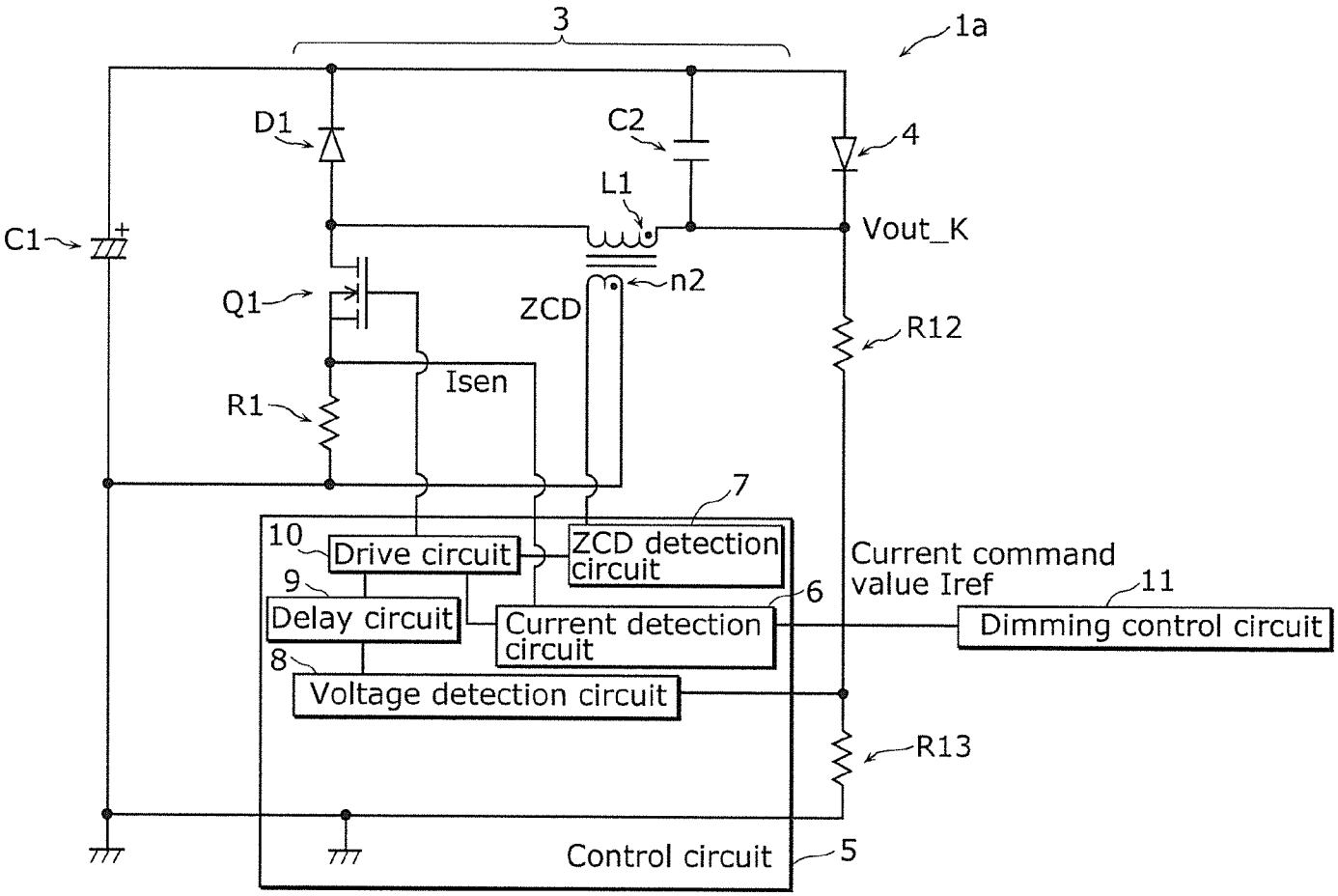
FIG. 1 is a circuit diagram of a lighting device according to Embodiment 1 of the present invention.
Figure 2:
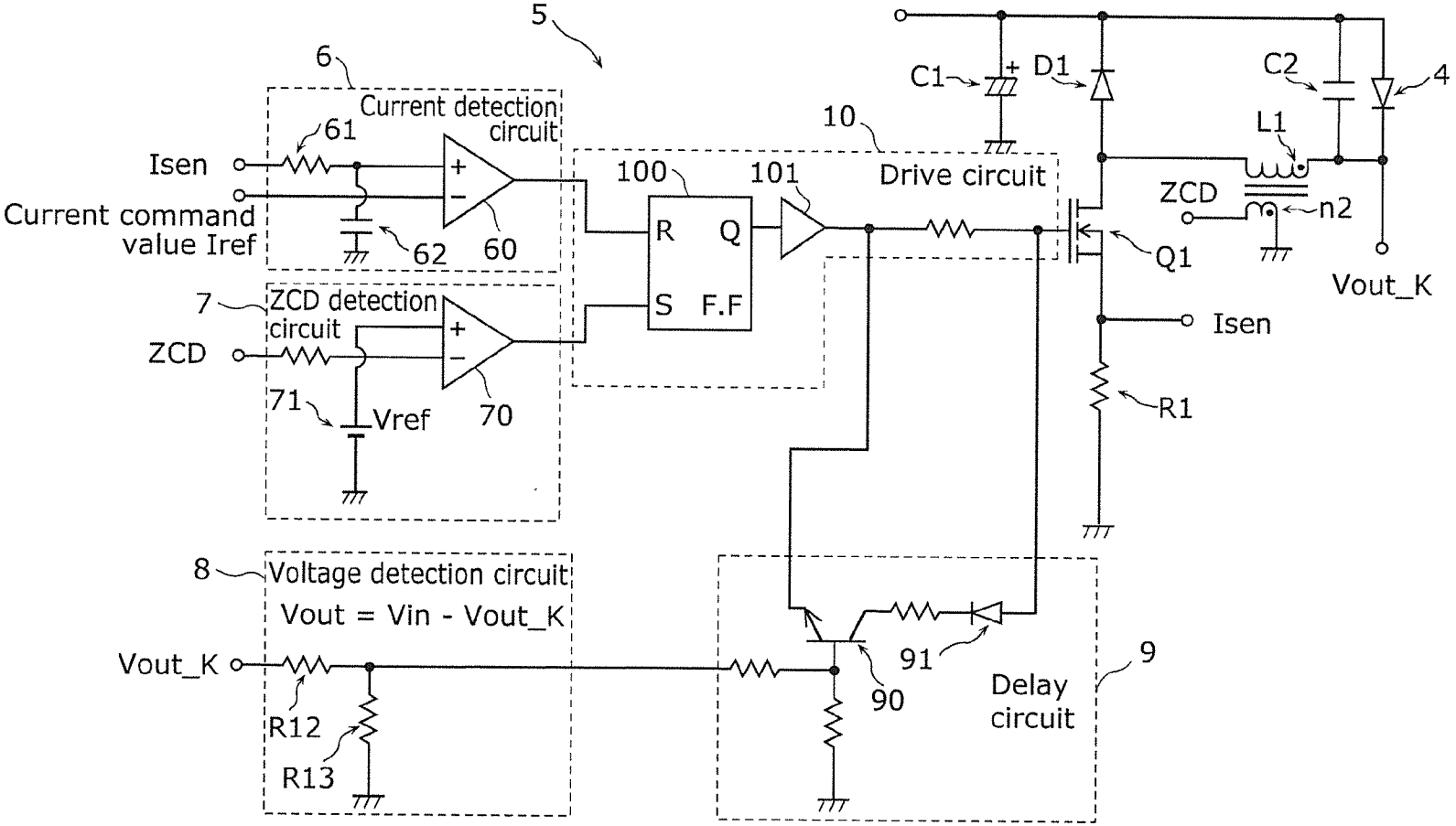
FIG. 2 is a detailed circuit diagram of a control circuit included in the lighting device according to Embodiment 1 of the present invention.

FIG. 1 is a circuit diagram of a lighting device 1*a* in Embodiment 1 of the present invention, and FIG. 2 is a detailed circuit diagram of a control circuit 5 included in the lighting device 1*a*. This technique is different from a background art in that a delay circuit 9 is added in the control circuit 5.

The lighting device 1*a* is a device for lighting up an LED 4, which is an example of a solid-state light-emitting element serving as a load, and includes a smoothing capacitor C1 serving as a DC power source, a buck converter 3, the control circuit 5 for controlling the buck converter 3, and a dimming control circuit 11. The buck converter 3 is a constant current output converter that receives an electric current from the smoothing capacitor C1 serving as a DC power source and supplies a predetermined electric current to the LED 4. In other words, this lighting device 1*a* includes the smoothing capacitor C1 serving as a DC power source, the buck converter 3 that steps down a DC voltage of the smoothing capacitor C1 and supplies a DC current to the solid-state light-emitting element (here, LED 4) serving as a load, the control circuit 5 for the buck converter 3, and the dimming control circuit 11.

The smoothing capacitor C1 serving as a DC power source is, for example, charged with a DC voltage obtained by full-wave rectifying a commercial AC power source with a full-wave rectifier (not shown). In general, an AC input side of the full-wave rectifier is provided with a filter circuit for removing a high frequency component. Further, a power factor improvement circuit using a boosting chopper circuit or the like may be provided between a DC output side of the full-wave rectifier and the smoothing capacitor C1.

The dimming control circuit 11 is a circuit for transmitting a current command value Iref to the control circuit 5 (more precisely, a current detection circuit 6 in the control circuit 5). For that purpose, the dimming control circuit 11, for example, receives an external dimming signal (not shown), sets a target of an output electric current Iout of the lighting device 1*a* that can achieve desired light output, and calculates the current command value Iref for achieving that output electric current Iout. Incidentally, the current command value Iref is a voltage corresponding to the magnitude of the output electric current Iout to be commanded, for example.

The buck converter 3 includes a switching element Q1, an inductor L1 and a diode D1 as major structural components. The inductor L1 is connected in series with the switching element Q1 and the LED 4 that is lit up with a DC current. An electric current from the smoothing capacitor C1 flows through the inductor L1 when the switching element Q1 is ON. The switching element Q1 is an element for connecting a series circuit including the inductor L1 and the LED 4 across the smoothing capacitor C1 and, for example, a transistor or the like. The diode D1 is a flywheel diode that supplies an electric current from the inductor L1 to the LED 4. In other words, the diode D1 is connected in parallel with the series circuit including the inductor L1 and the LED 4, and releases stored energy of the inductor L1 to the LED 4 when the switching element Q1 is OFF. Further, an output capacitor C2 is connected in parallel with the LED 4. This output capacitor C2 has a capacity set so as to smooth a ripple component generated due to ON/OFF of the switching element Q1, thus allowing a smoothed DC current to flow through the LED 4. It should be note that the LED 4 may be a single LED chip or an LED module obtained by connecting a plurality of LEDs in series, in parallel or in series-parallel.

Resistors R12 and R13 shown in FIG. 1 are voltage dividing resistors for detecting a voltage Vout_K at a connection point of the LED 4 and the inductor L1, and belong to a voltage detection circuit 8 as described later. It should be noted that the voltage Vout_K is also a voltage at a cathode of the LED 4 and thus also referred to as a cathode voltage Vout_K. Further, the resistor R1 is a resistor for detecting an electric current flowing through the switching element Q1, and belongs to the current detection circuit 6 as described later.

The control circuit 5 generates a signal that turns ON/OFF the switching element Q1 at high frequencies, and controls an electric current IL1 flowing through the inductor L1 so that an appropriate electric current flows through the load (LED 4). The control circuit 5 includes the current detection circuit 6, a ZCD detection circuit 7, the voltage detection circuit 8, a delay circuit 9 and a drive circuit 10.

FIG. 2 illustrates a simplified internal configuration of the control circuit 5 used in the present embodiment.

The current detection circuit 6 monitors a voltage at a connection point of the resistor R1 for current detection and the switching element Q1, thereby detecting an electric current flowing through the switching element Q1 as a detected value Isen. More specifically, as shown in FIG. 2, the current detection circuit 6 includes a comparator 60, a resistor 61 and a capacitor 62. In the current detection circuit 6, a signal indicating the detected value Isen is smoothed by a low pass filter composed of the resistor 61 and the capacitor 62, and inputted to the comparator 60. Then, the comparator 60 compares the detected value Isen and the current command value Iref from the dimming control circuit 11, and outputs a signal indicating when the detected value Isen is larger than the current command value Iref to the drive circuit 10.

The ZCD detection circuit 7 is an example of a circuit for detecting a time when the inductor L1 releases predetermined energy. In the present embodiment, the ZCD detection circuit 7 detects that a voltage of a secondary winding n2 coupled to the inductor L1 is lower than or equal to a threshold voltage Vref, thereby detecting that the electric current IL1 reaches substantially zero. More specifically, as shown in FIG. 2, the ZCD detection circuit 7 includes a comparator 70, a reference voltage generator 71 for generating the threshold voltage Vref, and so on. The ZCD detection circuit 7 compares, by the comparator 70, the voltage of the secondary winding n2 coupled to the inductor L1 and the threshold voltage Vref generated by the reference voltage generator 71, and outputs a signal indicating when the voltage of the secondary winding n2 is lower than the threshold voltage Vref to the drive circuit 10.

The voltage detection circuit 8 is an example of a circuit for detecting a forward voltage of the LED 4 or a voltage across the inductor L1. In the present embodiment, the voltage detection circuit 8 detects the cathode voltage Vout_K, thereby detecting a voltage VL across the inductor L1 during a period in which the switching element Q1 is ON. More specifically, as shown in FIG. 2, the voltage detection circuit 8 divides the cathode voltage Vout_K with the resistors R12 and R13, and outputs the obtained divided voltage to the delay circuit 9. Incidentally, during the period in which the switching element Q1 is ON, the cathode voltage Vout_K is substantially equal to the voltage VL across the inductor L1. This is because the ON resistance of the switching element Q1 and the resistor R1 are so small as to be negligible. Also, since an anode voltage of the LED 4 is equal to a voltage Vc1 across the smoothing capacitor C1 (a constant value), an output voltage Vout to the LED 4 is Vout=Vc1−Vout_K. It should be noted that the output voltage Vout is a voltage applied across the LED 4 and also a forward voltage of the LED 4.

The delay circuit 9 is a circuit for generating a delay time corresponding to the voltage detected by the voltage detection circuit 8, and generates delay in correspondence with the voltage VL across the inductor L1 at OFF timing of the switching element Q1. More specifically, as shown in FIG. 2, the delay circuit 9 includes a transistor 90 that regulates an electric current extracted from a gate of the switching element Q1, a diode 91 and so on. With such a circuit configuration, as a voltage from the voltage detection circuit 8 drops, a base potential of the transistor 90 lowers. This reduces an electric current flowing through the transistor 90, namely, the electric current extracted from the gate of the switching element Q1, and increases the above-mentioned delay. Therefore, this delay circuit 9 generates a longer delay time with a decrease in the voltage VL across the inductor L1 (or an increase in the forward voltage of the LED 4). Consequently, the delay circuit 9 generates a delay time so that a peak value of the electric current flowing through the inductor L1 is constant regardless of the voltage detected by the voltage detection circuit 8.

The drive circuit 10 generates a control signal for turning ON/OFF the switching element Q1, and outputs the generated control signal to the gate of the switching element Q1. This control signal turns OFF the switching element Q1 after a lapse of the delay time generated by the delay circuit 9 from when the electric current detected by the current detection circuit 6 (the detected value Isen) reaches a predetermined current command value (the current command value Iref). Further, this control signal turns ON the switching element Q1 when the inductor L1 releases predetermined energy (in the present embodiment, when the ZCD detection circuit 7 detects that the electric current IL1 reaches substantially zero). In other words, the drive circuit 10 is a circuit that receives the results of detection by the current detection circuit 6 and the ZCD detection circuit 7, generates a gate signal of the switching element Q1 and drives the switching element Q1. Incidentally, since the resistor R1 is a small resistor for current detection, it does not substantially affect the gate signal.

More specifically, as shown in FIG. 2, the drive circuit 10 includes a flip-flop 100, a buffer amplifier 101 and so on. The flip-flop 100 is reset when the electric current detected by the current detection circuit 6 (the detected value Isen) reaches the predetermined current command value Iref. Then, the flip-flop 100 is set when the inductor L1 releases the predetermined energy (when the ZCD detection circuit 7 detects that the electric current IL1 reaches substantially zero). The buffer amplifier 101 outputs an output signal from the flip-flop 100 to the gate of the switching element Q1 as a control signal. Here, the delay circuit 9 is provided between the buffer amplifier 101 and the gate of the switching element Q1. In this manner, the buffer amplifier 101 delays an output signal indicating that the flip-flop 100 is reset (namely, a signal for turning OFF the switching element Q1) by the delay time generated by the delay circuit 9 and outputs this output signal to the gate of the switching element Q1.

Now, the following is a description of an operation of the lighting device 1*a* in the present embodiment configured as above.

First, peak current control and Boundary Current Mode (BCM) control, which are basic operations of the buck converter 3 in the present embodiment, will be described. They are the same as the operations described in Japanese Unexamined Patent Application Publication No. 2012-109141. In the peak current control, the switching element Q1 is turned OFF when the electric current IL1 of the inductor L1 reaches a predetermined value. In the BCM control, the switching element Q1 is turned ON when the electric current IL1 reaches substantially zero.

When the switching element Q1 is ON, an electric current flows from a positive electrode of the smoothing capacitor C1 via the output capacitor C2, the inductor L1, the switching element Q1 and the resistor R1 to a negative electrode of the smoothing capacitor C1. At this time, a chopper current IL1 flowing through the inductor L1 increases substantially linearly unless the inductor L1 is magnetically saturated. Since the voltage VL across the inductor L1 is a difference between the voltage Vc1 across the smoothing capacitor C1 and a voltage Vc2 across the output capacitor C2, the electric current IL1 of the inductor L1 has a substantially constant inclination di/dt (≈VL/L1=(Vc1−Vc2)/L1). Thus, when the voltage Vc2 across the output capacitor C2, namely, the output voltage is high, the electric current IL1 of the inductor L1 slowly increases. When the output voltage thereof is low, the electric current IL1 increases rapidly.

A value of an electric current flowing through the inductor L1 while the switching element Q1 is ON is detected by the current detection circuit 6 from a voltage generated in the resistor R1 connected in series with the switching element Q1. The current detection circuit 6 includes the comparator 60 that compares the detected value Isen with the current command value Iref, etc. The current command value Iref is set by the dimming control circuit 11 so that an electric current peak target value Ipeak_T is twice as much as a target value Iout_T of the output electric current according to a detection ratio of the detected value Isen detected by the resistor R1 (a ratio between an actual electric current value and a detected voltage). For example, when R1=0.1Ω and Iout_T=1 A, Ipeak_T=2 A and Iref=0.2 V.

Thus, when an inductor electric current reaches the electric current peak target value Ipeak_T defined by the current command value Iref, the detected value Isen of the current detection circuit 6 exceeds the current command value Iref, so that an output of the comparator 60 results in a High level. Consequently, a reset signal is inputted to a reset input terminal R of the flip-flop (FF) 100 in the drive circuit 10. This causes a Q output of the flip-flop 100 to be at a Low level. Accordingly, a gate-source electric charge of the switching element Q1 is extracted, so that the switching element Q1 is turned OFF immediately.

While the switching element Q1 is OFF, electromagnetic energy stored in the inductor L1 is released to the output capacitor C2 via the diode D1. At this time, since the voltage across the inductor L1 is clamped by the voltage Vc2 of the output capacitor C2, an electric current i of the inductor L1 decreases at a substantially constant inclination di/dt (≈−Vc2/L1).

During a period in which the electric current is flowing through the inductor L1, a voltage corresponding to the inclination of the electric current of the inductor L1 is generated in the secondary winding n2 of the inductor L1. This voltage disappears when the electric current IL1 of the inductor L1 finishes flowing. The ZCD detection circuit 7 detects this timing.

The ZCD detection circuit 7 includes the comparator 70 for zero cross detection. The voltage generated in the secondary winding n2 of the inductor L1 is connected to a negative input terminal of the comparator 70, whereas the threshold voltage Vref for zero cross detection generated in the reference voltage generator 71 is applied to a positive input terminal of the comparator 70. When the voltage of the secondary winding n2 disappears, an output of the comparator 70 turns to a High level, and a set pulse is supplied to a set input terminal S of the flip-flop 100 in the drive circuit 10. Consequently, the Q output of the flip-flop 100 turns to a High level, and a gate signal of the switching element Q1 is applied so as to turn ON the switching element Q1.

By repeating such operations, the inductor electric current IL1 achieves a waveform that has a constant peak value and turns back up at a point of substantially zero. At this time, the output voltage Vout is equal to the voltage Vc2 across the output capacitor C2, and the output electric current Iout has a value of an average of the inductor electric current IL1, namely, about a half of the peak current value.

An increase in the output voltage Vout automatically extends an ON time of the switching element Q1 and shortens an OFF time thereof. A decrease in the output voltage Vout automatically shortens the ON time of the switching element Q1 and extends the OFF time thereof. Therefore, it is possible to maintain constant electric current properties regardless of the voltage characteristics of the load (LED 4).

Now, as mentioned earlier in the background art section, since the components constituting the buck converter 3 have a delay time, there occurs a delay time td0 from the timing of detecting an electric current peak before the timing of switching OFF.

Figure 3:
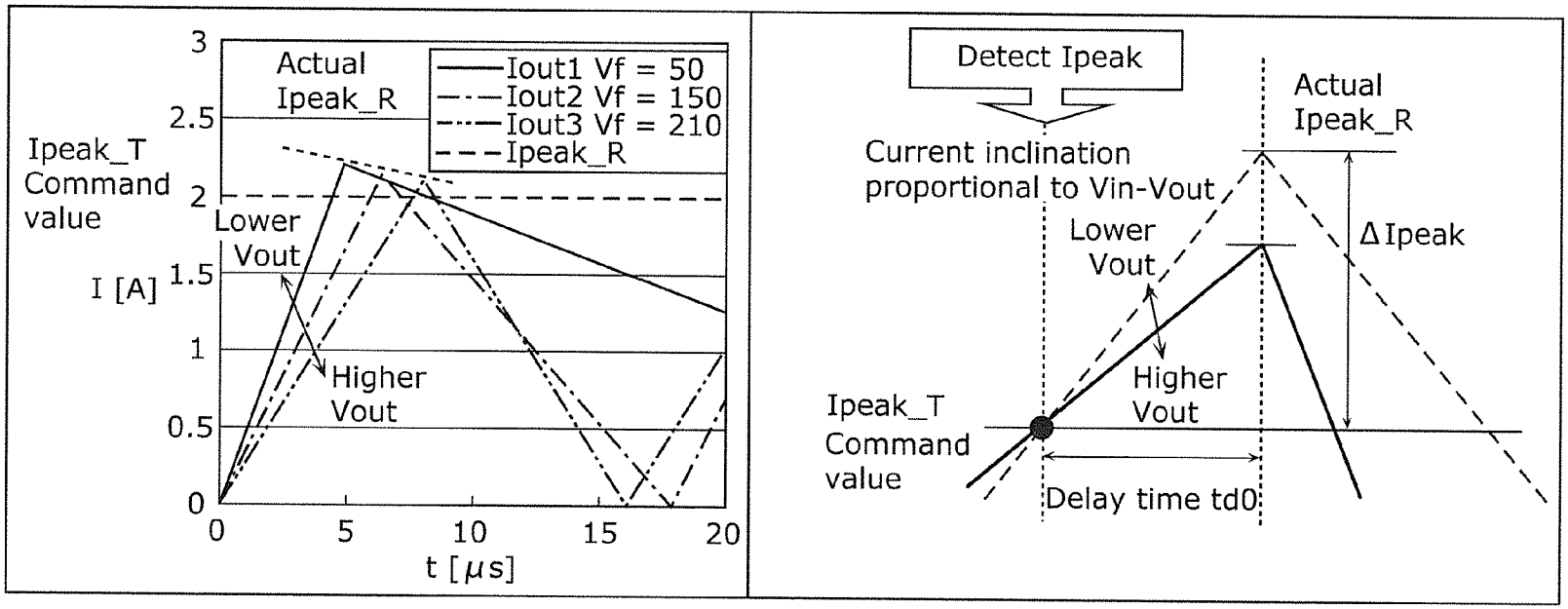
FIG. 3 shows variations in peak value of an electric current flowing through an inductor in a lighting device of a background art.

As shown in FIG. 3, due to such a delay time td0, an actual electric current peak value Ipeak_R of the electric current IL1 flowing through the inductor L1 is larger than the current peak target value Ipeak_T (current command value). FIG. 3 shows variations in actual electric current peak value Ipeak_R of an electric current flowing through the inductor L1 (the inductor electric current IL1) in a lighting device of a background art. A section on the left in FIG. 3 shows various exemplary electric current peak values Ipeak_R, and a section on the right in FIG. 3 shows an enlarged view of a waveform of the inductor electric current IL1 near the electric current peak value Ipeak_R. As can be understood from the formula below, the output voltage Vout of the buck converter 3 decreases with an increase in the difference between the actual peak current value Ipeak_R and the electric current peak target value Ipeak_T: Δipeak=Ipeak_R−Ipeak_T.

$$\Delta i\text{peak}=I\text{peak_}R-I\text{peak_}T=di/dt\times td0=(Vc1-V\text{out})/L\times td0$$

Figure 4:
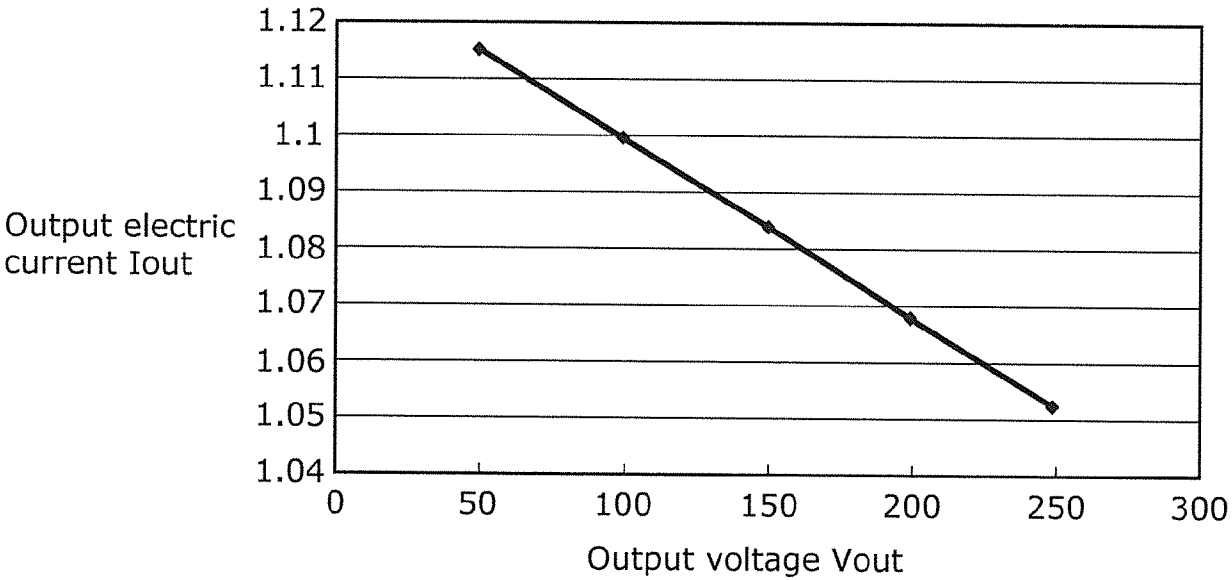
FIG. 4 shows output voltage-current characteristics in the lighting device of the background art.

This is because, even if the delay time td0 is constant, the inclination of the electric current of inductor L1 during the period in which the switching element Q1 is ON is di/dt≈VL/L1=(Vc1−Vout)/L1, i.e., the inclination di/dt varies depending on the output voltage Vout. Accordingly, when the buck converter 3 is operated merely by the boundary current mode (BCM) control and the peak current control, the output voltage-current characteristics do not achieve perfect constant current properties but achieve properties as in a background art shown in FIG. 4 in which the output electric current Iout increases with a decrease in the output voltage Vout. FIG. 4 shows the output voltage-current characteristics in a lighting device of a background art. The output voltage-current characteristics shown here are as follows.

$$I\text{out}=I\text{peak_}R/2=(\Delta i\text{peak}+I\text{peak_}T)/2=(Vc1-V\text{out})/L\times td0/2+I\text{peak_}T/2$$

In an actual lighting device having such characteristics, when there is an individual difference in forward voltage (namely, output voltage Vout) among loads (LEDs 4) to be connected, the output electric current varies individually, resulting in variations in light output. Also, when different types of loads having the same current rating and different voltage ratings are connected or when a plurality of the same loads are connected in series in a circuit, it might not be able to achieve desired light output because the difference in output voltage causes the output electric current to deviate from a rated range.

For example, when a plurality of LED modules with a forward voltage (namely, an output voltage Vout) rated at 100 V are connected in series in a lighting device having the output voltage-current characteristics shown in FIG. 4, the output electric current is 1.10 A in the case where the number of the series-connected loads is one (Vout=100 V), and the output electric current is 1.04 A in the case where the number thereof is three (Vout=300 V). The output electric current varies by 60 mA. Accordingly, even when the same LED modules are used, the light output per LED varies depending on the number of the LEDs connected in series. Incidentally, the condition for calculating the above-noted output electric current is Vc1=420 V, inductor L=800 μH, td0=500 nS and Ipeak_T=2 A.

Thus, in the present embodiment, the switching element Q1 is turned OFF after a lapse of a predetermined delay time from when the inductor electric current IL1 reaches the electric current peak value Ipeak_T defined by the current command value Iref while the switching element Q1 is ON. For that purpose, the lighting device 1*a* in the present embodiment includes the delay circuit 9 in the control circuit 5. In this way, the difference Δipeak between the actual peak current value Ipeak_R of the inductor electric current IL1 and the current peak target value Ipeak_T is kept constant regardless of the output voltage Vout, thereby suppressing the variations in output electric current caused by the difference in output voltage.

The delay circuit 9 includes the transistor 90 that regulates a speed of extracting the gate-source electric charge of the switching element Q1, and delays the timing of turning OFF the switching element Q1 according to the voltage VL across the inductor L1 in the voltage detection circuit 8. This makes it possible to easily estimate the inclination of the electric current of the inductor L1 from the voltage VL, and to also estimate an optimal delay time td that keeps the difference Δipeak between the actual peak current value Ipeak_R and the current peak target value Ipeak_T constant regardless of the output voltage Vout.

In the following, a method for setting the optimal delay time td will be explained.

The formula below represents a delay time td_total from when the inductor electric current IL1 reaches the electric current peak value Ipeak_T defined by the current command value Iref until the switching element Q1 is actually turned OFF. In other words, the delay time td_total is considered as a total of a delay time td0 (a constant value) of components of the buck converter 3 other than the delay circuit (i.e., a detection operation circuit, a driver IC and so on) and the delay time td of the delay circuit 9.

$$td_total = td + td0$$

The delay time td of the delay circuit 9 is set to have a minimum value td_min when the output voltage Vout is at a minimum possible value (Vout_min) of the forward voltage of an assumed load (LED 4). It is desired that this minimum value td_min should be substantially zero.

In other words, while the output voltage Vout is at the minimum value Vout_min, the total of the delay time td0 of the components of the buck converter 3 other than the delay circuit (e.g., a detection operation circuit, a driver IC and so on) and the minimum value td_min of the delay time of the delay circuit 9, namely, td_total_min=td0+td_min is set as the delay time when the switching element Q1 is OFF.

Here, when the minimum value of the delay time td_min≈0 is set, td_total_min≈td0.

It is appropriate that the delay time td_total from when the current detection circuit 6 detects the peak value until the switching element Q1 is turned OFF should be set as td_total={td0*(Vc1−Vout_min)}/(Vc1−Vout). In this manner, the actual peak current value Ipeak_R can be kept constant regardless of the magnitude of the output voltage Vout.

Figure 5:
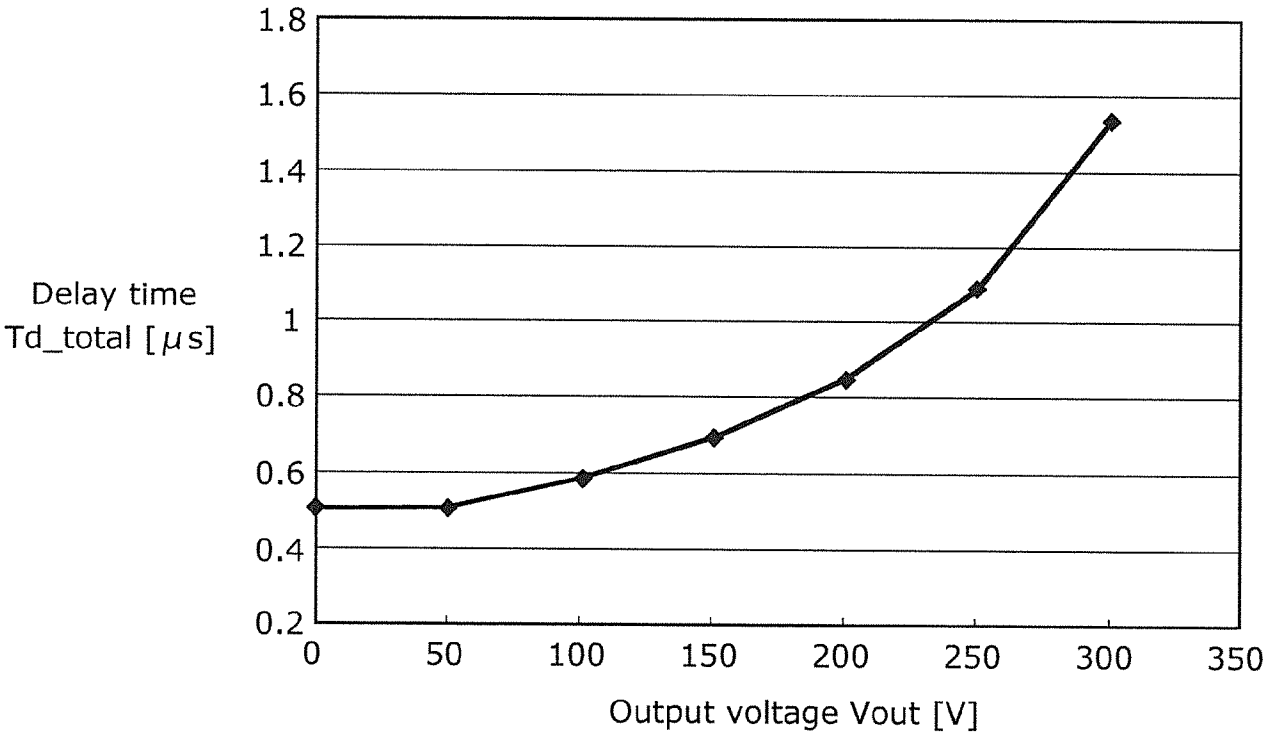
FIG. 5 shows the relationship between the output voltage and a delay time of the lighting device according to Embodiment 1 of the present invention.

FIG. 5 shows the relationship between the output voltage Vout and the delay time td_total when Vc1=420 V, Vout_min=50 V, td0=500 nS and inductor L=800 μH in the formula above.

From the above-noted formula, the delay time td generated by the delay circuit 9 is as follows.

$$td = td_total - td0 = \{td0*(Vc1 - Vout_min)\}/(Vc1 - Vout) - td0.$$

Figure 6:
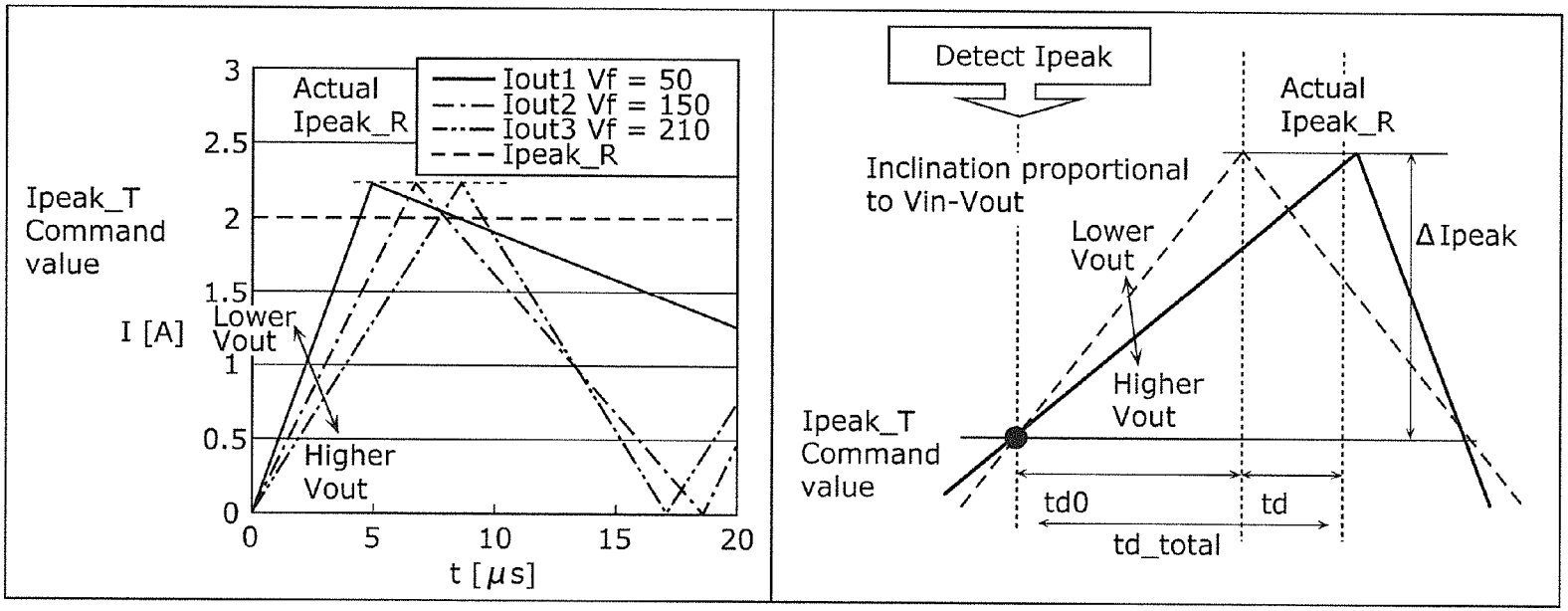
FIG. 6 shows an actual electric current peak value with respect to various output voltages in the lighting device according to Embodiment 1 of the present invention.

The delay time td expressed by the above formula is set, thereby making it possible to keep the difference Δipeak between the actual peak current value Ipeak_R and the current peak target value Ipeak_T constant regardless of the output voltage Vout as shown in FIG. 6. FIG. 6 shows the actual electric current peak value Ipeak_R with respect to various output voltages Vout in the lighting device 1*a* of the present embodiment. A section on the left in FIG. 6 shows an exemplary electric current peak value Ipeak_R with respect to various output voltages Vout, and a section on the right in FIG. 6 shows an enlarged view of a waveform of the inductor electric current IL1 near the electric current peak value Ipeak_R.

Figure 7:
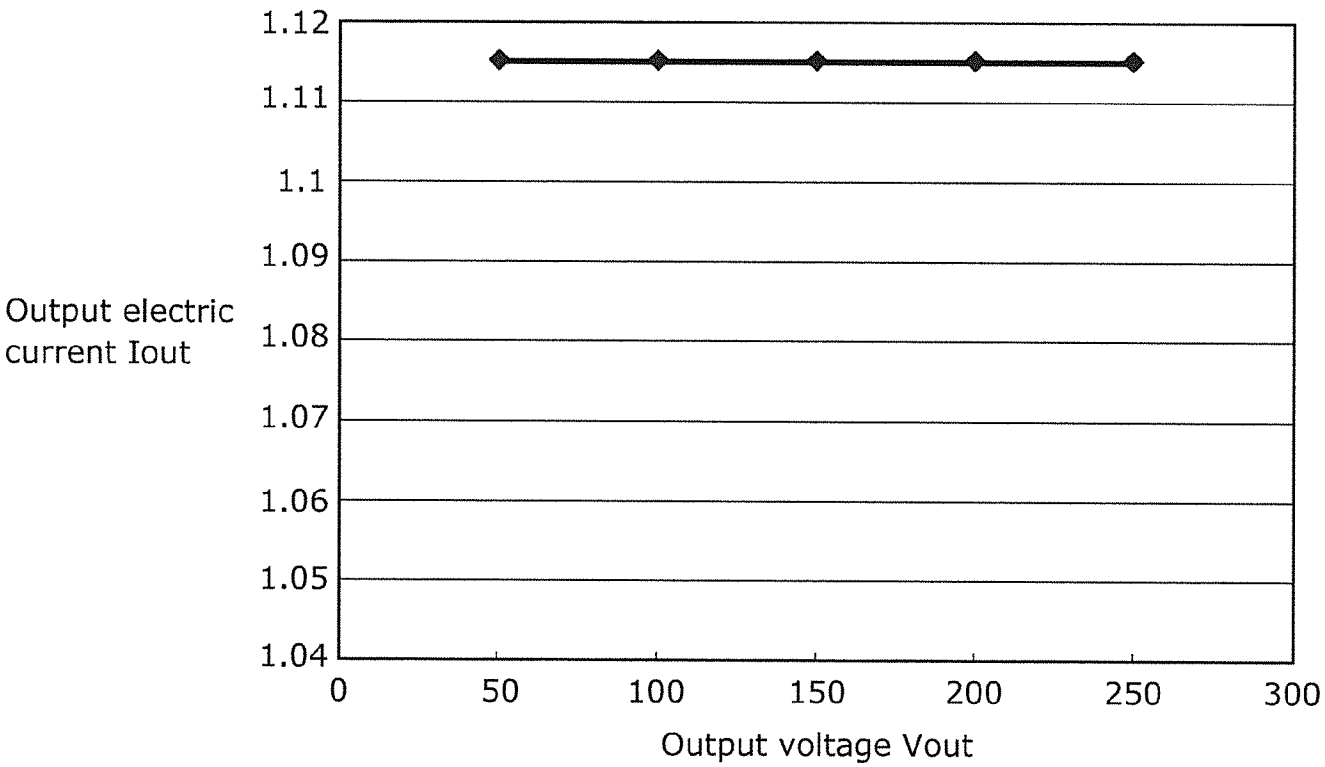
FIG. 7 shows output voltage-current characteristics in the lighting device according to Embodiment 1 of the present invention.

The control using the delay time set as above makes it possible to keep the output voltage-current characteristics of the lighting device 1*a* constant regardless of the output voltage Vout as shown in FIG. 7. FIG. 7 shows the output voltage-current characteristics in the lighting device 1*a* of the present embodiment.

Note that, although the delay circuit 9 as described above can keep the output electric current Iout constant regardless of the output voltage Vout, an increase in the electric current peak value Ipeak_R causes the output electric current Iout to deviate from the current peak target value Ipeak_T. Thus, it is preferable that the current peak target value Ipeak_T should be modified as shown in the formula below.

$$\text{Current peak target value } Ipeak_T = \text{Output electric current } Iout\ target \times 2 - \{td0*(Vc1 - Vout_min)\}/L$$

In other words, it is appropriate that the current command value Iref should be determined according to an electric current detection ratio so that the peak detection in the current detection circuit 6 is carried out for the modified current peak target value Ipeak_T as noted above.

For example, when Vc1=420 V, Vout_min=50 V, Inductor L=800 μH, td0=500 nS and R1=0.1Ω, Iref=0.177 V may be set to obtain the output electric current target Iout_T=1 A.

Incidentally, the buck converter 3 that can achieve the present embodiment does not have to be the circuit shown in FIG. 1 but may be a converter in which the inclination of an electric current flowing through the inductor varies according to the output voltage when the switching element Q1 is ON. In other words, the buck converter 3 is appropriate as long as it is of a type in which an electric current flows from the positive electrode of the smoothing capacitor C1 via the output capacitor C2 and the inductor L1 to the negative electrode of the smoothing capacitor C1. It should be noted that details, for example, a positive and a negative of the logic in the detection circuits sometimes have to be changed partially according to the circuit configuration to be adopted.

As described above, Embodiment 1 includes a means of keeping the peak value of an electric current flowing through the inductor L1 constant regardless of the output voltage Vout by turning OFF the switching element Q1 after a lapse of the delay time by the delay circuit 9, and making that delay time variable according to the voltage across the inductor L1. This makes it possible to achieve the lighting device 1*a* that keeps the output electric current Iout constant regardless of the output voltage Vout. Thus, even when there are variations in forward voltage of the LEDs 4 serving as a load or when loads (LEDs 4) with different voltage ratings are connected, a desired electric current can be passed through these loads, so that desired light output can be achieved.

Embodiment 2

Next, a lighting device according to Embodiment 2 of the present invention will be described.

Embodiment 2 is different from Embodiment 1 in the configuration of the buck converter and part of the control circuit.

However, the basic operation of the buck converter in Embodiment 2 is similar to that in Embodiment 1. Thus, the following description of Embodiment 2 will be directed only to the difference from Embodiment 1.

In Embodiment 1, the method of changing the speed of extracting a gate-source electric charge of the switching element Q1 has been discussed as the method for generating the delay time by the delay circuit 9. However, with such a method, there is a possibility that the generated delay time might vary due to component-to-component variations in the threshold voltage, gate capacity and so on of the switching element Q1.

Accordingly, the present embodiment will illustrate a delay circuit that can generate an accurate delay time with reduced variations.

Figure 8:
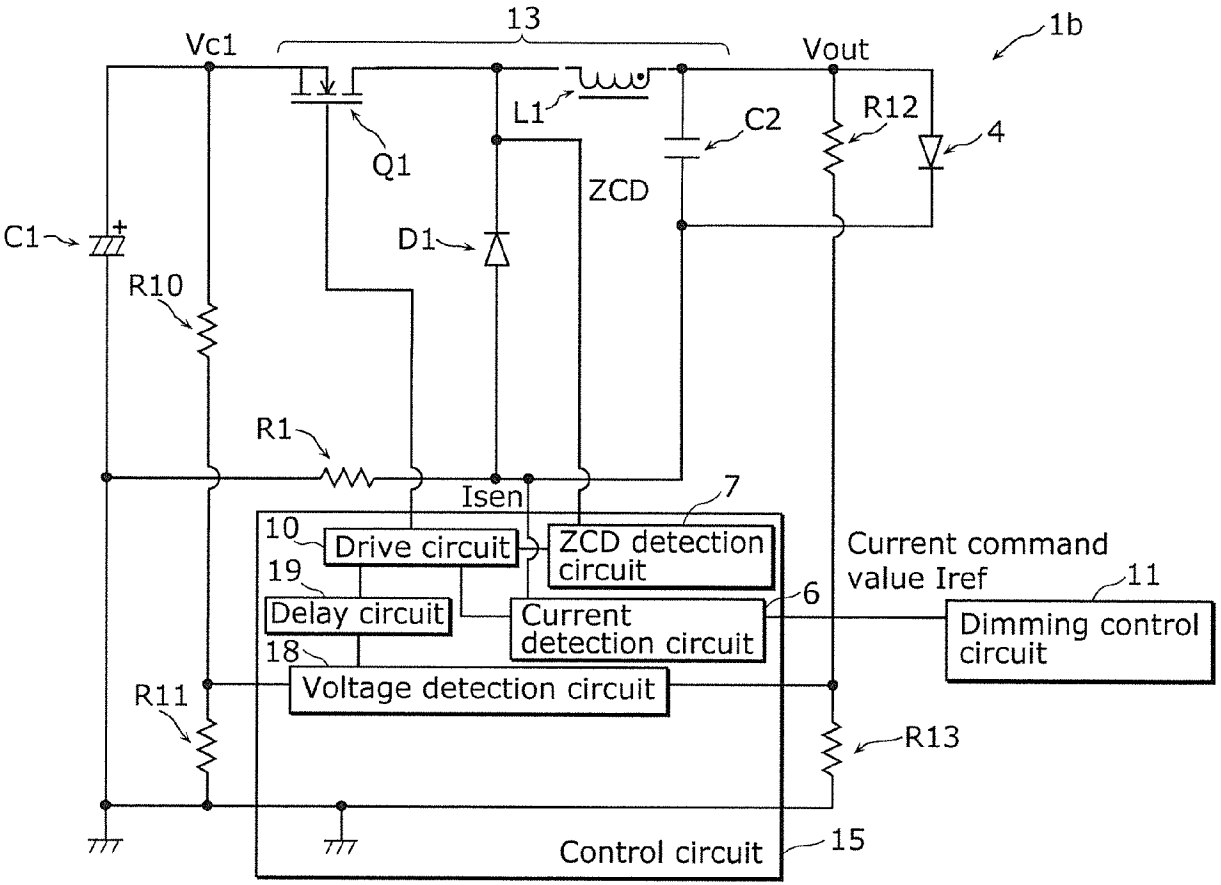
FIG. 8 is a circuit diagram of a lighting device according to Embodiment 2 of the present invention.
Figure 9:
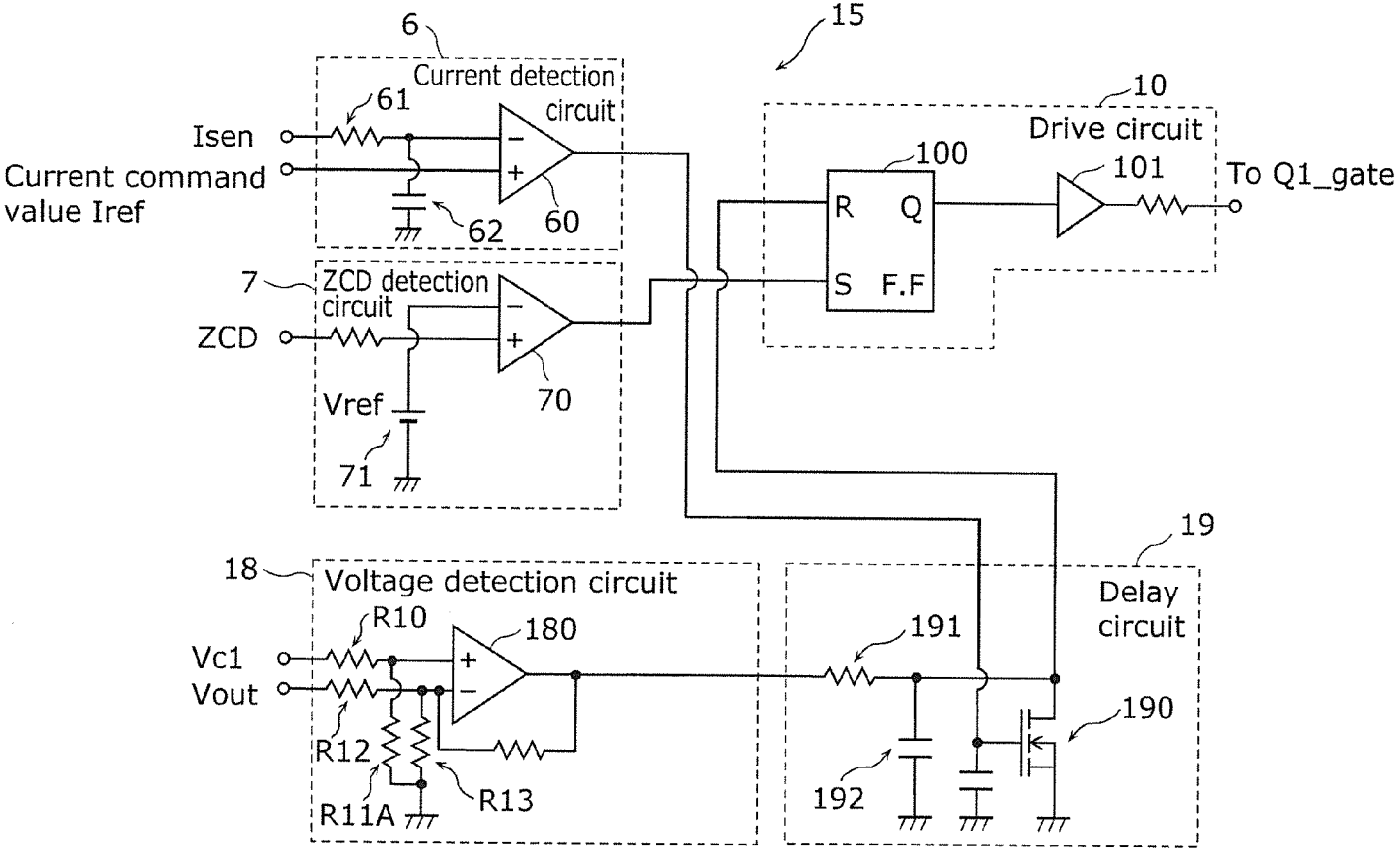
FIG. 9 is a detailed circuit diagram of a control circuit included in the lighting device according to Embodiment 2 of the present invention.

FIG. 8 illustrates a circuit diagram of a lighting device 1*b* in the present embodiment, and FIG. 9 illustrates a circuit diagram of a control circuit 15 included in the lighting device 1*b*. In the present embodiment, the circuit configurations of a buck converter 13 and the control circuit 15 (in particular, a voltage detection circuit 18 and a delay circuit 19) are different from those in Embodiment 1.

The buck converter 13 in Embodiment 2 employs a system in which the switching element Q1 is driven on a High side and the ZCD detection circuit 7 does not use the secondary winding n2 of the inductor L1. As described in Embodiment 1, the buck converter may be any converter in which the inclination of an electric current flowing through the inductor L1 varies according to the output voltage when the switching element Q1 is ON. In other words, the buck converter may be any converter in which an electric current flows from the positive electrode of the smoothing capacitor C1 via the output capacitor C2 and the inductor L1 to the negative electrode of the smoothing capacitor C1. The buck converter 13 in the present embodiment is also one example of such a converter.

In the present embodiment, the voltage detection circuit 18 calculates the difference between a voltage Vc1 in the smoothing capacitor C1 and an output voltage Vout, thereby detecting a voltage VL across the inductor L1 during the period in which the switching element Q1 is ON. For that purpose, the voltage detection circuit 18 includes a differential amplifier 180 for detecting the difference between the voltage Vc1 and the output voltage Vout as shown in FIG. 9.

Further, as for a current detection circuit 6, input terminals of a comparator 60 provided in the current detection circuit 6 and a comparator 70 provided in a ZCD detection circuit 7 are connected as shown in FIG. 9. Note that the connection is reversed from that in Embodiment 1.

The delay circuit 19 is connected between the current detection circuit 6 and a drive circuit 10, and can generate a delay time according to a voltage from the voltage detection circuit 18 by a delay caused by an RC circuit. For that purpose, the delay circuit 19 includes a resistor 191 and a capacitor 192 constituting a low-pass filter for delaying a voltage from the voltage detection circuit 18, and a transistor 190, etc. With such a circuit configuration, when a Low level signal is outputted from the current detection circuit 6, the transistor 190 is turned OFF, and a signal that rises at a speed corresponding to the voltage from the voltage detection circuit 18 is generated at a drain of the transistor 190 and inputted in the drive circuit 10. At this time, the rising speed of the voltage at the drain of the transistor 190 decreases in keeping with the voltage from the voltage detection circuit 18, namely, the voltage VL across the inductor L1. Therefore, this delay circuit 19 generates a signal whose rising speed is lower, namely, a longer delay time with a decrease in the voltage VL across the inductor L1 (or an increase in the forward voltage of the LED 4). Incidentally, for even higher accuracy, a dedicated delay circuit or a digital circuit such as a microprocessor may be used as the delay circuit 19.

A source voltage of the switching element Q1 is inputted to the ZCD detection circuit 7 as an input signal to the ZCD detection circuit 7 (a ZCD signal). The comparator 70 detects that the ZCD signal reaches the threshold voltage Vref from a reference voltage generator 71 during a period in which the switching element Q1 is OFF, and outputs a set signal to a set input terminal of a flip-flop 100 in the drive circuit 10.

A value of an electric current flowing through the inductor L1 while the switching element Q1 is ON is detected by the current detection circuit 6 from a voltage generated in the resistor R1 connected in series with the switching element Q1. When an inductor electric current reaches the electric current peak target value Ipeak_T defined by the current command value Iref, the detected value Isen of the current detection circuit 6 exceeds the current command value Iref, so that an output of the comparator 60 turns to a High level. The delay circuit 19 receives this signal, and outputs a reset signal to a reset input terminal R of the flip-flop 100 in the drive circuit 10 after a lapse of the delay time according to the result VL (=Vc1−Vout) detected by the voltage detection circuit 8. This causes a Q output of the flip-flop 100 to be at a Low level. Accordingly, a gate-source electric charge of the switching element Q1 is extracted, so that the switching element Q1 is turned OFF immediately.

In other words, in the present embodiment, the flip-flop 100 in the drive circuit 10 is reset after a lapse of the delay time generated by the delay circuit 19 from when an electric current detected by the current detection circuit 6 reaches a predetermined current command value. Then, the flip-flop 100 is set when the inductor L1 releases the predetermined energy (in the present embodiment, when the ZCD detection circuit 7 detects that the electric current IL1 reaches substantially zero). The buffer amplifier 101 outputs an output signal from the flip-flop 100 to the gate of the switching element Q1 as a control signal. In this way, the switching element Q1 is turned OFF after a lapse of the delay time generated by the delay circuit 19 from when the electric current detected by the current detection circuit 6 reaches the predetermined current command value.

It should be noted that the setting of the delay time is similar to that in Embodiment 1. In other words, it is appropriate that the delay time td_total from when the current detection circuit 6 detects the peak value until the switching element Q1 is turned OFF should be set as td_total={td0* (Vc1−Vout_min)}/(Vc1−Vout). In this manner, the actual peak current value Ipeak_R can be kept constant regardless of the magnitude of the output voltage Vout.

As indicated in the present embodiment, the buck converter adopted here may have any circuit configuration as long as the inclination of an electric current flowing through the inductor varies according to the output voltage when the switching element Q1 is ON. In other words, the buck converter in an embodiment of the present invention may be any converter in which an electric current flows from the positive electrode of the smoothing capacitor C1 via the output capacitor C2 and the inductor L1 to the negative electrode of the smoothing capacitor C1. At that time, it is appropriate to provide a configuration in which, according to the adopted circuit configuration, voltages of individual components in the voltage detection circuit 8 are detected and the voltage VL across the inductor L1 during a period in which the switching element Q1 is ON is calculated.

In this way, Embodiment 2 uses a circuit capable of generating an accurate delay time as the delay circuit 19, thereby ensuring more accurate constant current properties of the output electric current.

Embodiment 3

Next, a lighting device according to Embodiment 3 of the present invention will be described.

Embodiment 3 is different from Embodiments 1 and 2 in that plural sets of a buck converter, a control circuit and a solid-state light-emitting element (here, an LED) are provided.

Figure 10:
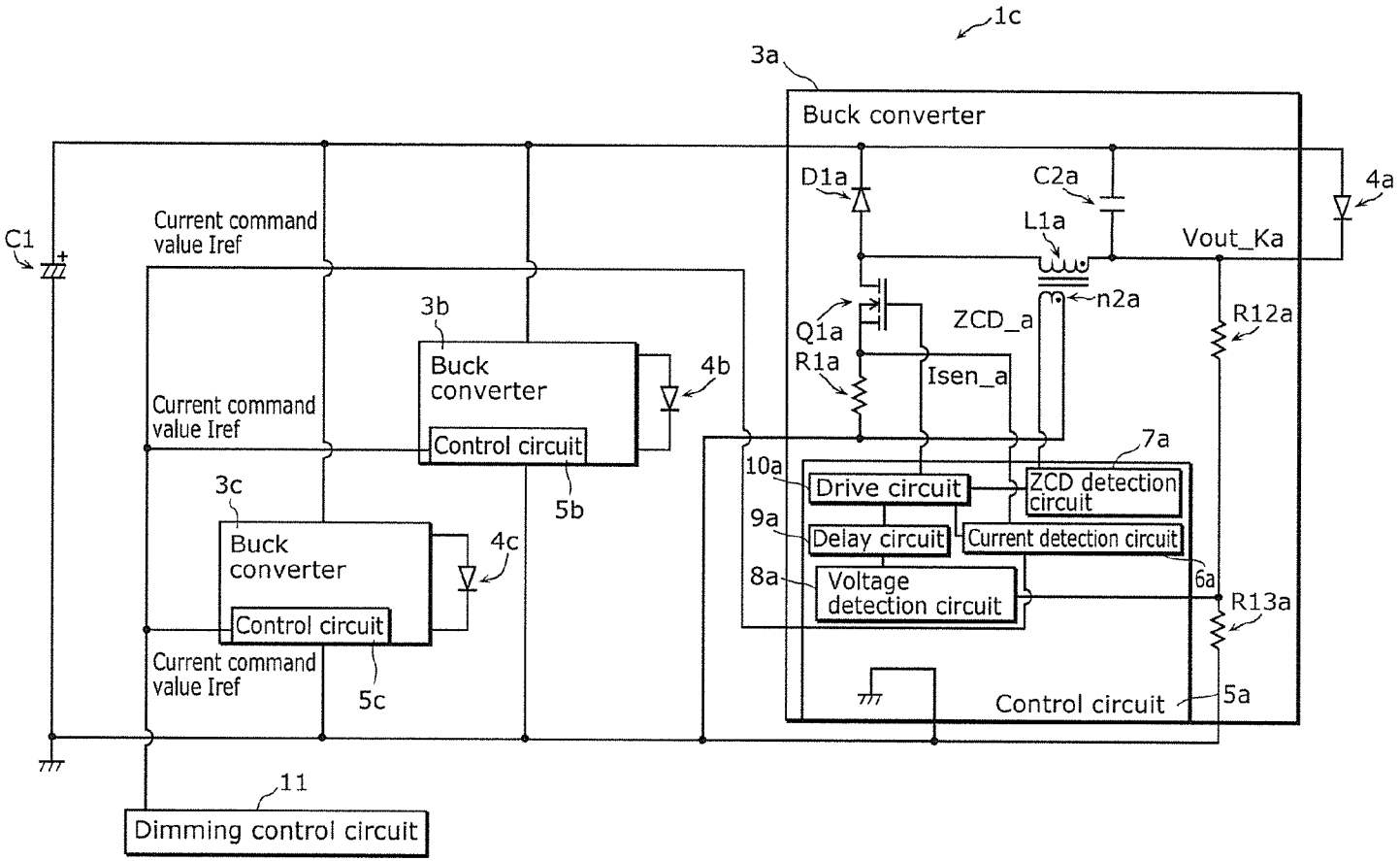
FIG. 10 is a circuit diagram of a lighting device according to Embodiment 3 of the present invention.

FIG. 10 is a circuit diagram of a lighting device 1*c* in Embodiment 3. This lighting device 1*c* includes a plurality of buck converters 3*a* to 3*c* for stepping down a DC voltage of the smoothing capacitor C1 serving as a common DC power source and supplying a DC current to LEDs 4*a* to 4*c* serving as loads, and a plurality of control circuits 5*a* to 5*c*. The present embodiment will be described using a circuit including three buck converters 3*a* to 3*c* and three control circuits 5*a* to 5*c*.

Each of the buck converters 3*a* to 3*c* has a circuit configuration similar to the buck converter 3 in Embodiment 1. For example, the buck converter 3*a* includes an inductor L1*a*, a switching element Q1*a*, a diode D1*a* and an output capacitor C2*a*.

Each of the control circuits 5*a* to 5*c* has a circuit configuration similar to the control circuit 5 in Embodiment 1. For example, the control circuit 5*a* includes a current detection circuit 6*a*, a ZCD detection circuit 7*a*, a voltage detection circuit 8*a*, a delay circuit 9*a* and a drive circuit 10*a*. A common current command value Iref is inputted from a dimming control circuit 11 to the three control circuits 5*a* to 5*c*.

Each of the buck converters 3*a* to 3*c* and its corresponding one of the control circuits 5*a* to 5*c* operate independently of each other and similarly to Embodiment 1. For example, as for the buck converter 3*a* and the control circuit 5*a*, the voltage VL across the inductor L1*a* is detected during a period in which the switching element Q1*a* is ON, and the switching element Q1*a* is turned OFF after a lapse of the delay time generated by the delay circuit 9*a* according to the voltage VL. In this way, the peak value of an electric current flowing through the inductor L1*a* (an actual peak current value Ipeak_R) is kept constant regardless of the output voltage Vout to the LED 4*a*.

Figure 11:
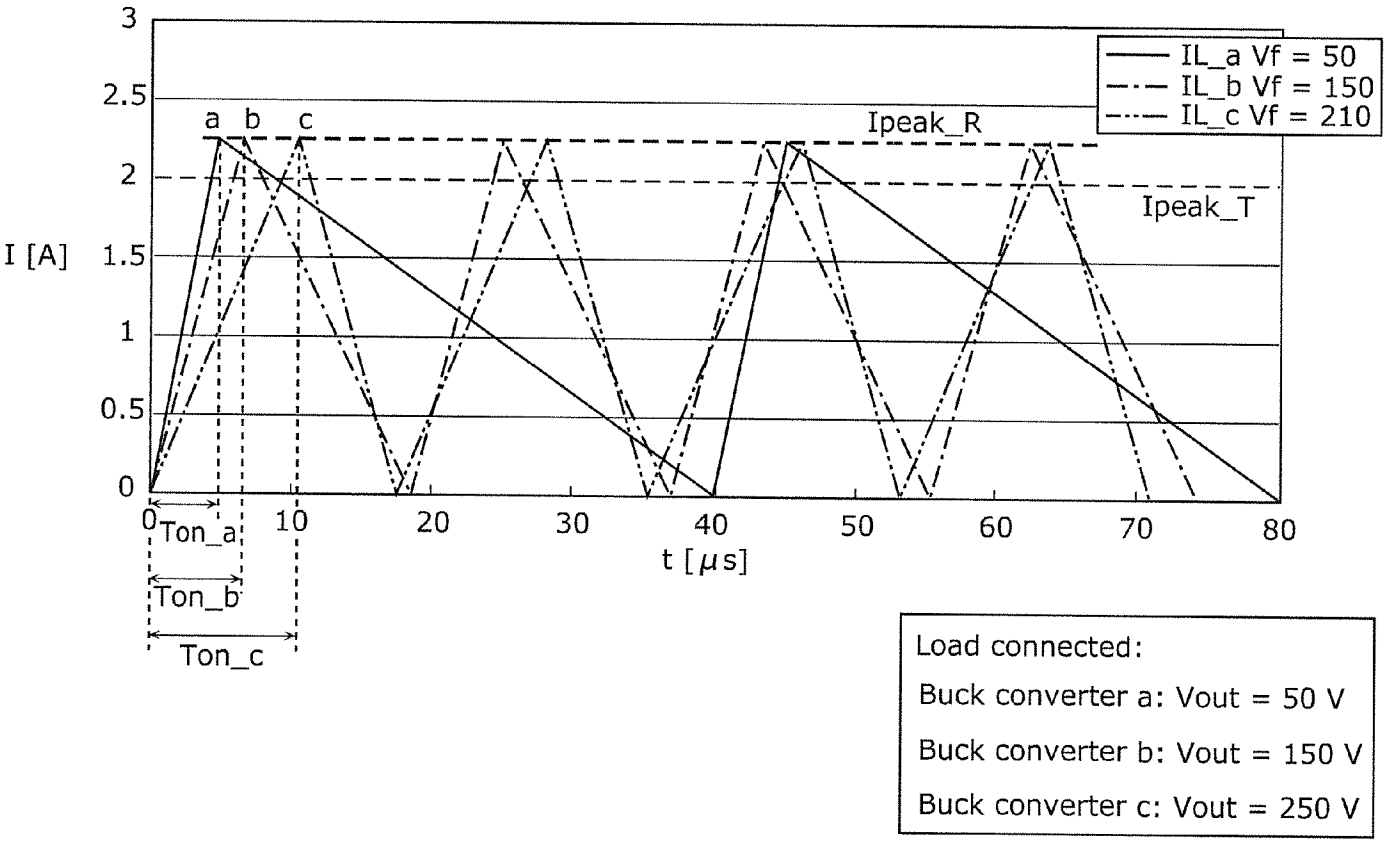
FIG. 11 shows exemplary waveforms of electric currents flowing through inductors in the respective buck converters in the lighting device according to Embodiment 3 of the present invention.

FIG. 11 illustrates exemplary waveforms of electric currents IL_a to IL_c flowing through the inductors in the respective buck converters 3*a* to 3*c*. The three buck converters 3*a* to 3*c* are connected with the following loads (LEDs 4*a* to 4*c*) having different rated voltages. In other words, the LED 4*a* connected to the buck converter 3*a* has a rated voltage Vout_a=50 V, the LED 4*b* connected to the buck converter 3*b* has a rated voltage Vout_b=150 V, and the LED 4*c* connected to the buck converter 3*c* has a rated voltage Vout_c=250 V.

As becomes clear from the exemplary waveforms in FIG. 11, although ON time periods Ton of the switching elements and electric current inclinations Δi are different among the individual buck converters 3*a* to 3*c*, the electric current peak value Ipeak_R is kept constant by setting the delay time dt according to the inductor voltage VL. As a result, the output electric current also becomes constant.

As described above, in the present embodiment, a simple circuit is used to ensure constant current properties in the output voltage-current characteristics at outputs of the individual buck converters 3*a* to 3*c*. Even when there are variations in forward voltage among the loads connected to the individual outputs, it is possible to reduce variations in the respective output electric currents. Furthermore, even when the loads with different rated voltages are connected, a constant electric current is outputted to the individual outputs, thereby obtaining a desired light output. Thus, it is possible to achieve a lighting device capable of ensuring a desired light output in each output and reducing the variations in light output among the entire outputs.

It should be noted that, although the lighting device 1*c* in the present embodiment includes three sets of the buck converter and the control circuit of Embodiment 1, it may include less or more sets of the buck converter and the control circuit or may include the buck converter and the control circuit of Embodiment 2.

Figure 12:
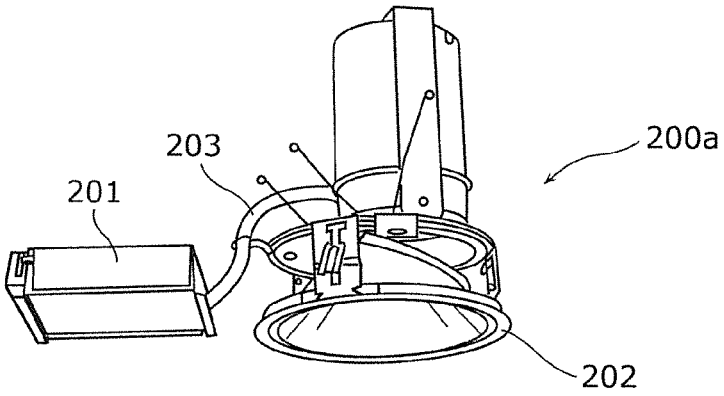
FIG. 12 shows an external appearance of an example of a luminaire according to an embodiment of the present invention.
Figure 13:
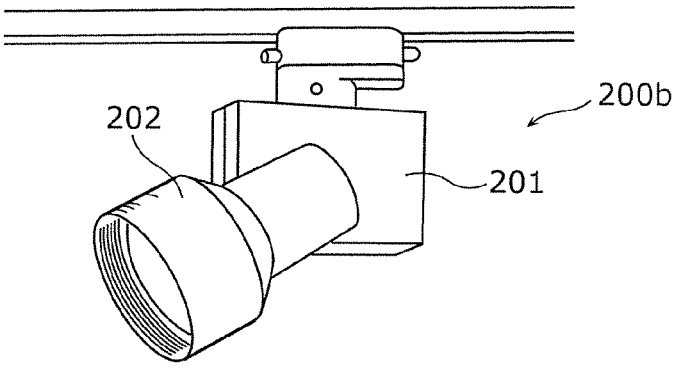
FIG. 13 shows an external appearance of another example of the luminaire according to an embodiment of the present invention.
Figure 14:
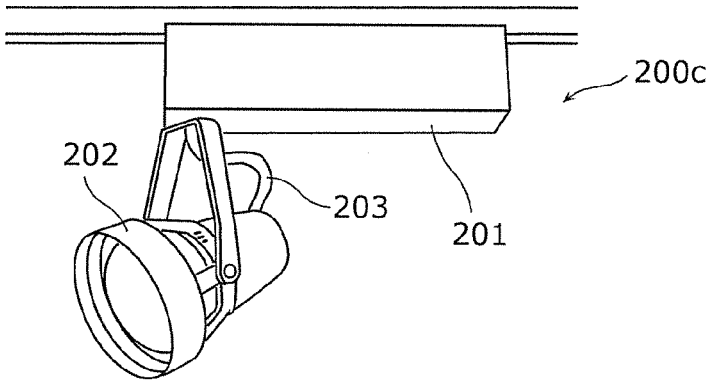
FIG. 14 shows an external appearance of another example of the luminaire according to an embodiment of the present invention.

Needless to say, the lighting devices 1*a* to 1*c* described in Embodiments 1 to 3 above are applicable to a luminaire. FIGS. 12 to 14 illustrate external appearances of luminaires including the lighting devices 1*a* to 1*c* in Embodiments 1 to 3 described above. Here, a down light 200*a* (FIG. 12), a spot light 200*b* (FIG. 13) and a spot light 200*c* (FIG. 14) are illustrated as exemplary luminaires. In the figures, numeral 201 denotes a circuit box containing a circuit of the lighting device (the buck converter and the control circuit), numeral 202 denotes a lamp on which an LED is mounted, and numeral 203 denotes wiring for electrically connecting the circuit box 201 and the LED in the lamp 202. The circuit box 201 contains, for example, the lighting device 1*a* in Embodiment 1, the lighting device 1*b* in Embodiment 2, or at least one set of circuits (the buck converter and the control circuit) in the lighting device 1*c* in Embodiment 3.

In the above-described luminaires, the lighting devices in the embodiments above are used, so that a simple configuration can achieve lighting with reduced light output variations. Moreover, when the lighting device 1*c* in Embodiment 3 described above is applied, even light output can be ensured among a plurality of the luminaires.

As described above, the lighting device in the above-described embodiments is a lighting device that lights up a solid-state light-emitting element (the LED 4 or the like), and includes: a DC power source (the smoothing capacitor C1); a buck converter 3 or the like that is a constant current output converter, and receives an electric current from the DC power source and supplies a predetermined electric current to the solid-state light-emitting element; and a control circuit 5 or the like that controls the buck converter 3 or the like. The buck converter 3 or the like includes: a switching element Q1; an inductor L1 that is connected in series with the switching element Q1, and through which the electric current from the DC power source flows when the switching element Q1 is ON; and a diode D1 that supplies, to the solid-state light-emitting element, the electric current released from the inductor L1. The control circuit 5 or the like includes: a current detection circuit 6 or the like that detects an electric current flowing through the switching element Q1; a voltage detection circuit 8 or the like that detects either one of a forward voltage of the solid-state light-emitting element and a voltage across the inductor L1; a delay circuit 9 or the like that generates a delay time according to the voltage detected by the voltage detection circuit 8 or the like; and a drive circuit 10 or the like that generates and outputs a control signal to the switching element Q1, the control signal turning OFF the switching element Q1 after a lapse of the delay time generated by the delay circuit 9 or the like from when the electric current detected by the current detection circuit 6 or the like reaches a predetermined current command value, and turning ON the switching element Q1 when the inductor L1 releases predetermined energy.

More specifically, the delay circuit 9 or the like generates the delay time so that a peak value of the electric current flowing through the inductor L1 is kept constant regardless of the voltage detected by the voltage detection circuit 8 or the like. For example, the delay circuit 9 or the like generates the delay time that is extended with either one of an increase in the forward voltage of the solid-state light-emitting element and a decrease in the voltage across the inductor L1.

In this manner, the output electric current is kept constant regardless of the magnitude of the output voltage. Thus, even when there are variations in forward voltage or rated voltage among the solid-state light-emitting elements, a constant electric current defined by the current command value is outputted to the solid-state light-emitting elements. Further, such constant current control is realized by a simple delay circuit. Accordingly, it is possible to achieve a lighting device including a switching power source circuit that is operated by the BCM control and the peak current control, the lighting device capable of stably lighting up solid-state light-emitting elements having different properties while suppressing variations in light output of these elements with a simple configuration.

Also, the delay circuit 9 or the like generates a minimum delay time as the delay time when the forward voltage of the solid-state light-emitting element connected to the lighting device is at a minimum value Vout_min, where Vout_min denotes a minimum value of the forward voltage of the solid-state light-emitting element to be connected to the lighting device. This minimizes the time from when the output electric current reaches a predetermined current command value until it reaches a peak current value, thereby suppressing the difference between the current command value and an actual peak current value.

Further, in Embodiment 1, the drive circuit 10 or the like includes: a flip-flop 100 that is reset when the electric current detected by the current detection circuit 6 reaches the predetermined current command value, and set when the inductor L1 releases the predetermined energy; and a buffer amplifier 101 that outputs an output signal from the flip-flop 100 to the switching element Q1 as the control signal. The buffer amplifier 101 outputs an output signal indicating that the flip-flop 100 has been reset to the switching element Q1 after the lapse of the delay time generated by the delay circuit 9. In this way, a simple circuit disposed between the drive circuit and the switching element achieves the delay circuit.

Also, in Embodiment 2, the drive circuit 10 includes: a flip-flop 100 that is reset after the lapse of the delay time generated by the delay circuit 10 from when the electric current detected by the current detection circuit 6 reaches the predetermined current command value, and set when the inductor L1 releases the predetermined energy; and a buffer amplifier 101 that outputs an output signal from the flip-flop 100 to the switching element Q1 as the control signal. In this way, a simple circuit disposed between the current detection circuit and the drive circuit achieves the delay circuit with high accuracy.

Moreover, in Embodiment 3, the lighting device 1*c* lights up a plurality of solid-state light-emitting elements, and includes: a plurality of buck converters 3*a* to 3*c* that are in one-to-one correspondence with the plurality of solid-state light-emitting elements; and a plurality of control circuits 5*a* to 5*c* that respectively control the plurality of buck converters 3*a* to 3*c*. At this time, the lighting device 1*c* further includes a dimming control circuit 11 that outputs the current command value according to a desired light output to the plurality of control circuits 5*a* to 5*c*. In this way, since the same output electric current defined by a common current command value is applied to the plurality of solid-state light-emitting elements, the magnitude of the light output evens out among the plurality of solid-state light-emitting elements, allowing illumination with reduced light output variations as a whole.

Additionally, the luminaire (the down light 200*a*, the spot lights 200*b* and 200*c*) in the above-described embodiment includes any of the lighting devices 1*a* to 1*c*; and a solid-state light-emitting element to which an electric current is supplied from the lighting device. This makes it possible to achieve stable illumination having reduced light output variations with a simple configuration. Furthermore, illumination with reduced light output variations can be achieved among a plurality of luminaires to which the lighting device according to Embodiment 3 above is applied.

The above description has been directed to the lighting device and the luminaire according to the present invention, with reference to the embodiments. However, the present invention is not limited to these embodiments. As long as not departing from the purpose of the present invention, various modifications that are conceived by a person with ordinary skill in the art and made to the present embodiments and modes that are constructed by combining the structural components in different embodiments may also fall within one or more aspects of the present invention.

For example, although the lighting device in the above-described embodiments has used the LED as the solid-state light-emitting element, the solid-state light-emitting element in the present invention may be any other solid-state light-emitting element such as an organic EL element.

Moreover, when the lighting devices in the above-described embodiments are applied to a plurality of luminaires, one type of the lighting devices in Embodiments 1 to 3 above may be applied to all the luminaires, or plural types of the above-noted lighting devices may be mixed and applied to the plurality of luminaires. Further, when the lighting device in Embodiment 3 above is applied to a plurality of luminaires, plural sets of the buck converter and the control circuit may be divided and received in individual luminaires or may be put together and received in a single luminaire.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device that lights up a solid-state light-emitting element, the lighting device comprising:

a DC power source;

a buck converter that is a constant current output converter, and receives an electric current from the DC power source and supplies a predetermined electric current to the solid-state light-emitting element; and a control circuit that controls the buck converter, wherein the buck converter includes:

a switching element;

an inductor that is connected in series with the switching element, and through which the electric current from the DC power source flows when the switching element is ON; and a diode that supplies, to the solid-state light-emitting element, the electric current released from the inductor, and the control circuit includes:

a current detection circuit that detects an electric current flowing through the switching element;

a voltage detection circuit that either is connected to one of end terminals of the solid-state light-emitting element and detects a forward voltage of the solid-state light-emitting element or is connected to one of end terminals of the inductor and detects a voltage across the inductor;

a delay circuit that generates a delay time that is variable according to the voltage detected by the voltage detection circuit; and a drive circuit that generates and outputs a control signal to the switching element, the control signal turning OFF the switching element after a lapse of the delay time generated by the delay circuit from when the electric current detected by the current detection circuit reaches a predetermined current command value, and turning ON the switching element when the inductor releases predetermined energy.

2. The lighting device according to claim 1, wherein the delay circuit generates the delay time so that a peak value of the electric current flowing through the inductor is kept constant regardless of the voltage detected by the voltage detection circuit.

3. The lighting device according to claim 1, wherein the delay circuit generates the delay time that is extended with either one of an increase in the forward voltage of the solid-state light-emitting element and a decrease in the voltage across the inductor.

4. The lighting device according to claim 1, wherein the delay circuit generates a minimum delay time as the delay time when the forward voltage of the solid-state light-emitting element connected to the lighting device is at a minimum value Vout_min, where Vout_min denotes a minimum value of the forward voltage of the solid-state light-emitting element to be connected to the lighting device.

5. The lighting device according to claim 1, wherein the drive circuit includes:

a flip-flop that is reset when the electric current detected by the current detection circuit reaches the predetermined current command value, and set when the inductor releases the predetermined energy; and a buffer amplifier that outputs an output signal from the flip-flop to the switching element as the control signal, and the buffer amplifier outputs an output signal indicating that the flip-flop has been reset to the switching element after the lapse of the delay time generated by the delay circuit.

6. The lighting device according to claim 1, wherein the drive circuit includes:

a flip-flop that is reset after the lapse of the delay time generated by the delay circuit from when the electric current detected by the current detection circuit reaches the predetermined current command value, and set when the inductor releases the predetermined energy; and a buffer amplifier that outputs an output signal from the flip-flop to the switching element as the control signal.

7. The lighting device according to claim 1, wherein the lighting device lights up a plurality of solid-state light-emitting elements, and the buck converter includes a plurality of buck converters that are in one-to-one correspondence with the plurality of solid-state light-emitting elements, and the control circuit includes a plurality of control circuits that respectively control the plurality of buck converters.

8. The lighting device according to claim 7, further comprising a dimming control circuit that outputs the current command value according to a desired light output to the plurality of control circuits.

9. A luminaire comprising:

the lighting device according to claim 1; and a solid-state light-emitting element to which an electric current is supplied from the lighting device.

* * * * *